US008324997B2

(12) United States Patent
Haas et al.

(10) Patent No.: US 8,324,997 B2
(45) Date of Patent: Dec. 4, 2012

(54) MOTOR DRIVE WITH A DEVICE FOR SAFE FITTING WITH A CIRCUIT BREAKER

(75) Inventors: Thomas Haas, Simmelsdorf (DE); Friedrich Obermeyer, Feucht (DE); Willibald Riss, Freudenberg (DE)

(73) Assignee: Siemens Aktiengesellschaft, Munich (DE)

( * ) Notice: Subject to any disclaimer, the term of this patent is extended or adjusted under 35 U.S.C. 154(b) by 87 days.

(21) Appl. No.: 12/898,079

(22) Filed: Oct. 5, 2010

(65) Prior Publication Data

US 2011/0080073 A1 Apr. 7, 2011

(30) Foreign Application Priority Data

Oct. 7, 2009 (DE) ..... 10 2009 048 461

(51) Int. Cl.
*H01H 9/02* (2006.01)

(52) U.S. Cl. ..... 335/202; 335/131

(58) Field of Classification Search ..... 335/202
See application file for complete search history.

(56) References Cited

U.S. PATENT DOCUMENTS 5,219,070 A * 6/1993 Grunert et al. ..... 200/330
5,323,131 A 6/1994 Castonguay

FOREIGN PATENT DOCUMENTS

DE 4124487 A1 7/1992

* cited by examiner

*Primary Examiner* — Elvin G Enad
*Assistant Examiner* — Lisa Homza
(74) *Attorney, Agent, or Firm* — Harness, Dickey & Pierce, P.L.C.

(57) ABSTRACT

A motor drive includes a device for safe fitting of the motor drive with a circuit breaker. In at least one embodiment, the device includes a first cover, whose position can be altered, for example by being guided in slotted links, in such a way that only the receiving opening provides a free space for receiving the handle, owing to the overlap by the first cover, and therefore it is only possible for the circuit breaker to be fitted on the motor drive when the handle is in the corresponding position.

19 Claims, 3 Drawing Sheets

MOTOR DRIVE WITH A DEVICE FOR SAFE FITTING WITH A CIRCUIT BREAKER

PRIORITY STATEMENT

The present application hereby claims priority under 35 U.S.C. §119 on German patent application number DE 10 2009 048 461.2 filed Oct. 7, 2009, the entire contents of which are hereby incorporated herein by reference.

FIELD

At least one embodiment of the invention generally relates to a motor drive with a device for safe fitting of the motor drive with a circuit breaker. In at least one embodiment, the device includes at least one cover, which prevents fitting of the motor drive with the circuit breaker in the event that a handle of the circuit breaker is in the incorrect position, and the device includes at least one receiving opening, which allows a handle of the circuit breaker to be received when the handle is in the correct position and which is used for coupling the motor drive to the handle of the circuit breaker.

BACKGROUND

Motor drives are known, for example, from U.S. Pat. No. 5,323,131. In order to prevent incorrect fitting of the circuit breaker with the motor drive, the device has a receiving opening which is mounted in such a way that the handle of the circuit breaker can only engage in said receiving opening in the correct position.

SUMMARY

In at least one embodiment of the invention, a motor drive is disclosed in which incorrect fitting is prevented in a simple manner.

In this case, the position of the first cover of the device can be altered, guided by slotted links, in such a way that only the receiving opening provides a free space for receiving the handle owing to the overlap by the first cover and it is therefore only possible for the circuit breaker to be fitted on the motor drive when the handle is in the corresponding position.

Advantageous developments of the invention are given in dependent claims.

An advantageous development of at least one embodiment of the motor drive is provided if the first cover is in the form of a plate.

A further advantageous development of at least one embodiment is provided if, in addition to the first cover, a second cover is provided, whose position can be altered in the same way as the first cover, guided in slotted links in such a way that only the receiving opening provides a free space for receiving the handle owing to the overlap by the first cover and the second cover and it is therefore only possible for the circuit breaker to be fitted on the motor drive when the handle is in a corresponding position.

It is furthermore advantageous if, in at least one embodiment, the first cover and the second cover are designed to be identical.

BRIEF DESCRIPTION OF THE DRAWINGS

An example embodiment of the invention will be explained in more detail below with reference to a drawing, in which.

DETAILED DESCRIPTION OF THE EXAMPLE EMBODIMENTS

Figure 1:
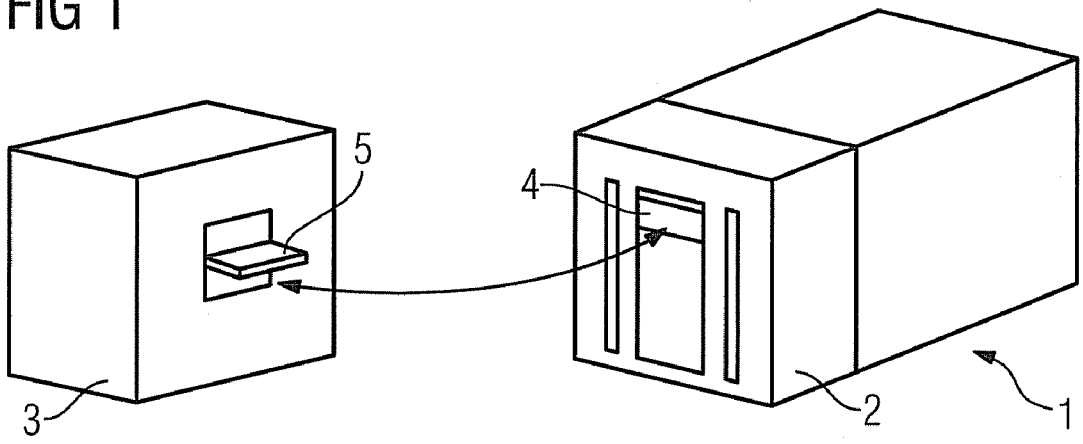
FIG. 1 shows a rough view of a motor drive according to an embodiment of the invention for fitting with a circuit breaker.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes,"

and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a motor drive 1 according to an embodiment of the invention with a device 2 for safe fitting of the motor drive 1 with a circuit breaker as well as the circuit breaker 3 itself. The motor drive 1 is used for remotely switching on and off the circuit breaker 3 via its handle 5. For this purpose, a coupling element (not illustrated here) is provided which can be moved by the motor drive 1 and has the receiving opening 4 illustrated in FIG. 1 for receiving the handle 5 of the circuit breaker 3 and for coupling the handle 5 to the motor drive 1.

In order to enable the handle 5 to move freely on the movement path, a rectangular opening with a corresponding width is provided as free space on the front side of the device 2.

The device 2 ensures that only the receiving opening 4 is freely accessible, while the rest of the area of the rectangular opening is at least partially covered. The handle 5 can only engage in the receiving opening 4 if it is in the correct position. Incorrect fitting of the circuit breaker 3 on the motor drive 1 is therefore ruled out.

Figure 2:
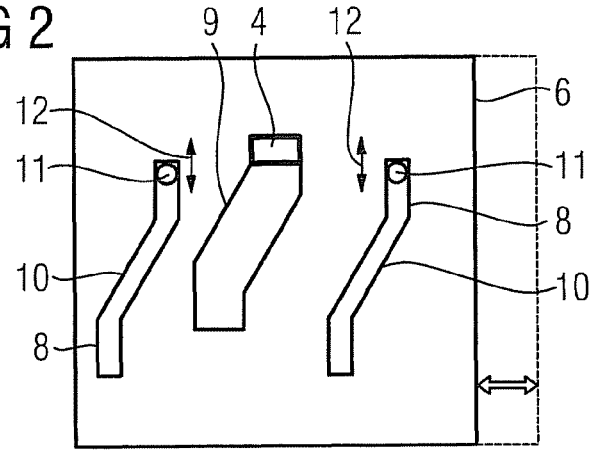
FIG. 2 shows a view of a first movable cover of the device of the motor drive according to an embodiment of the invention.
Figure 3:
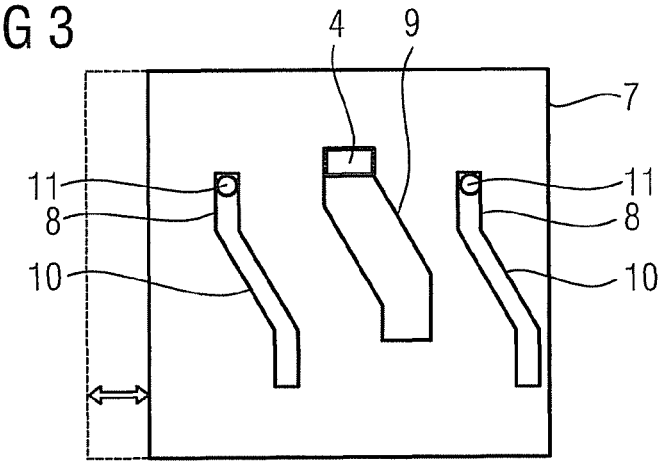
FIG. 3 shows a view of a second movable cover of the device of the motor drive according to an embodiment of the invention.
Figure 4:
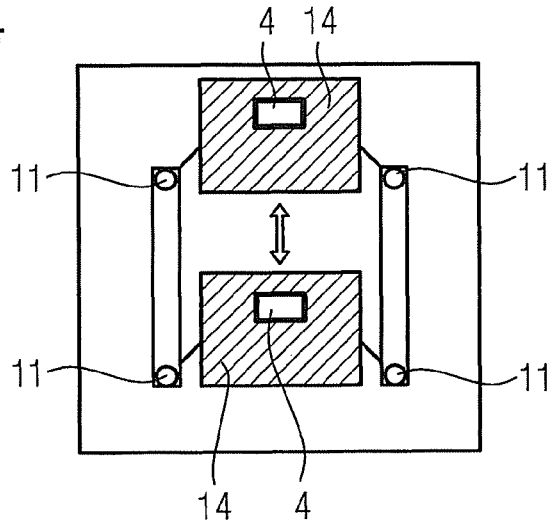
FIG. 4 shows a view of the coupling elements of the device of the motor drive according to an embodiment of the invention for coupling to a handle.
Figure 5:
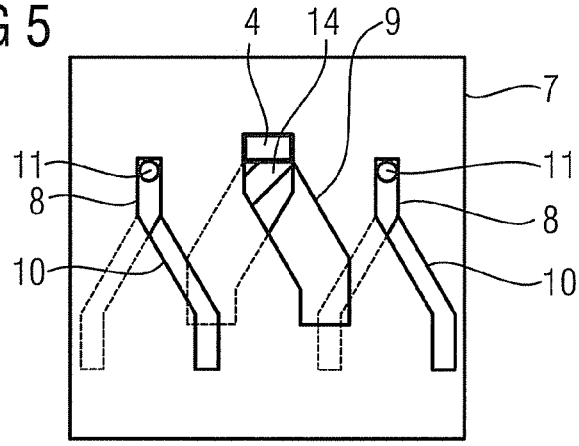
FIG. 5 shows a view of the first and second covers positioned one on top of the other.

In the case of the device 2, the rectangular opening is covered in the following way. The device 2 has a first movable cover 6, as shown in FIG. 2, and a second movable cover 7, as shown in FIG. 3. The two covers 6, 7 are in this case designed to be identical, in each case as a plate with two first outer slotted links 8 and a first central slotted link 9. A carry-along pin 11 engages in each of the two first outer slotted links 8, which are provided with the bevels 10. The two carry-along pins 11 are connected to the coupling element 14 which can be moved by the motor drive 1, as is illustrated schematically in FIG. 4. The carry-along pins 11 therefore move simultaneously with the coupling element 14, which has the receiving opening 4. By virtue of the movement of the carry-along pins 11 within the slotted links 8 in the direction indicated by the double arrows 12, the two covers 6, 7 are moved laterally at the same time, whilst being guided by a frame (not illustrated here). As can be seen from FIG. 5, the second cover 7 is positioned onto the first cover 6. The two carry-along pins 11 and therefore also the coupling element 14 with the receiving opening 4 are located in the upper position. The first central slotted links 9 are used as free space for the handle 5. A coupling of the handle 5 to the motor drive 1 is only possible in this case if the handle 5 is also in the upper position.

In the event of a movement of the coupling element 14 with the receiving opening 4 into the lower position, the two covers 6, 7 overlap the upper region of the rectangular opening at least partially. In this case, the two covers 6, 7 are shifted by the carry-along pins 11 within the slotted links 8 by virtue of the bevels 10 in the slotted links 8 in opposite directions.

The overlap can also be achieved by only a single first cover 6, however, by virtue of the bevels 10 in the slotted links 8 and therefore the displacement path being matched to the width of the rectangular opening.

Figure 6:
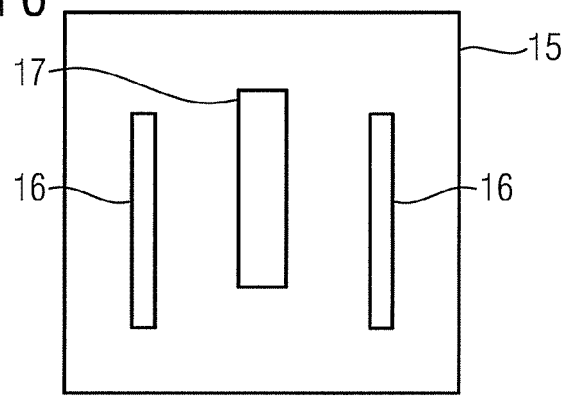
FIG. 6 shows a view of a fixed cover of the device of the motor drive according to an embodiment of the invention.
Figure 7:
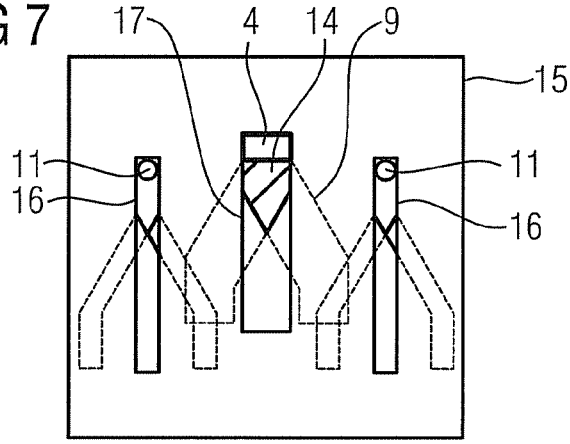
FIG. 7 shows a view of the device of the motor drive according to an embodiment of the invention with the fixed cover at the front and the movable covers therebeneath.

FIG. 6 shows a third, fixed cover 15, which is positioned onto the two other covers 6, 7, as illustrated in FIG. 7. It is used for fixing the two movable covers 6, 7 and has two second outer slotted links 16 for receiving the carry-along pins 11 and a second central slotted link 17, which leaves open the rectangular opening as free space for receiving the handle 5 over the movement path thereof.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A motor drive comprising:

a device for safe fitting of the motor drive with a circuit breaker, the device including at least one first cover, to prevent fitting of the motor drive with the circuit breaker when a handle of the circuit breaker is in an incorrect position; and at least one receiving opening, that receives the handle of the circuit breaker when the handle is in a correct position and to couple the motor drive to the handle of the circuit breaker, a position of the at least one first cover of the device being alterable in such a way that only the at least one receiving opening provides a free space for receiving the handle owing to an overlap by the at least one first cover, the circuit breaker only being fittable on the motor drive when the handle is in a correct corresponding position.

2. The motor drive as claimed in claim 1, wherein the at least one first cover has a form of a plate.

3. The motor drive as claimed in claim 2, wherein the at least one first cover includes a second cover, a position of the second cover being alterable in a same way as the first cover, guidable in such a way that only the receiving opening provides a free space for receiving the handle owing to the overlap by the first cover and the second cover, and the circuit breaker only being fittable on the motor drive when the handle is in the corresponding correct position.

4. The motor drive as claimed in claim 3, wherein the first cover and the second cover of the device are alterably guidable by slotted links.

5. The motor drive as claimed in claim 4, wherein the first cover and the second cover are identical.

6. The motor drive as claimed in claim 3, wherein the first cover and the second cover are identical.

7. The motor drive as claimed in claim 3, wherein the at least one cover includes a third cover, which is fixed and fixes at least one of the first cover and the second cover.

8. The motor drive as claimed in claim 1, wherein the at least one first cover includes a second cover, a position of the second cover being alterable in the same way as the first cover, guidable in such a way that only the receiving opening provides the free space for receiving the handle owing to the overlap by the first cover and the second cover, and the circuit breaker only being fittable on the motor drive when the handle is in the corresponding correct position.

9. The motor drive as claimed in claim 8, wherein the first cover and the second cover are identical.

10. The motor drive as claimed in claim 8, wherein the at least one cover includes a third cover, which is fixed and fixes at least one of the first cover and the second cover.

11. The motor drive as claimed in claim 8, wherein the first cover and the second cover of the device are alterably guidable by slotted links.

12. The motor drive as claimed in claim 11, wherein the first cover and the second cover are identical.

13. The motor drive as claimed in claim 1, wherein the at least one first cover of the device is alterably guidable by slotted links.

14. A device for safe fitting of a motor drive with a circuit breaker, the device comprising:

at least one first cover, to prevent fitting of the motor drive with the circuit breaker when a handle of the circuit breaker is in an incorrect position; and at least one receiving opening, that receives the handle of the circuit breaker when the handle is in a correct position and to couple the motor drive to the handle of the circuit breaker, a position of the at least one first cover of the device being alterable in such a way that only the at least one receiving opening provides a free space for receiving the handle owing to an overlap by the at least one first cover, the circuit breaker only being fittable on the motor drive when the handle is in the correct corresponding position.

15. The device as claimed in claim 14, wherein the at least one first cover has a form of a plate.

16. The device as claimed in claim 14, wherein the at least one first cover includes a second cover, a position of the second cover being alterable in same way as the first cover, guidable in such a way that only the receiving opening provides a free space for receiving the handle owing to overlap by the first cover and the second cover, and the circuit breaker only being fittable on the motor drive when the handle is in the corresponding correct position.

17. The device as claimed in claim 16, wherein the first cover and the second cover are identical.

18. The device as claimed in claim 16, wherein the at least one cover includes a third cover, which is fixed and fixes at least one of the first cover and the second cover.

19. The device as claimed in claim 14, wherein the at least one first cover of the device is alterably guidable by slotted links.

* * * * *